United States Patent [19]

Frederick

[11] Patent Number: 4,995,322

[45] Date of Patent: Feb. 26, 1991

[54] EXTERNALLY MOUNTED R.V. TABLE

[76] Inventor: Percy R. Frederick, 14578 Tulloch Dam Rd., Jamestown, Calif. 95327

[21] Appl. No.: 938,078

[22] Filed: Dec. 4, 1986

[51] Int. Cl.[5] ..... A47B 23/00

[52] U.S. Cl. ..... 108/44; 108/38

[58] Field of Search ..... 108/44, 47, 48, 42, 108/38, 39, 134; 296/26, 27, 156, 37.1; 248/188.6, 188.5

[56] References Cited

U.S. PATENT DOCUMENTS

| | | | |
|---|---|---|---|
| 1,317,895 | 10/1919 | Rudy | 108/38 X |
| 2,214,575 | 9/1940 | Cercownay . | |
| 2,580,618 | 1/1952 | Terrell | 108/134 X |
| 2,875,007 | 2/1959 | Fox | 248/188.5 |
| 3,080,832 | 3/1963 | Schroemges | 108/134 X |
| 3,159,114 | 12/1964 | Haunost | 108/38 |
| 3,226,776 | 1/1966 | Van Wormer | 108/42 X |
| 3,242,882 | 3/1966 | Hoyt | 108/48 |
| 3,257,933 | 6/1966 | Baylinson | 108/48 X |
| 3,709,159 | 1/1973 | Oglesby, Jr. . | |
| 3,866,547 | 2/1975 | Guyton | 108/38 |
| 3,912,324 | 10/1975 | Trogler . | |
| 4,029,355 | 6/1977 | Wichelmsen | 108/134 X |
| 4,068,601 | 1/1978 | Marsh . | |
| 4,155,609 | 5/1979 | Skafte et al. | 108/48 X |
| 4,236,461 | 12/1980 | Barksdale . | |
| 4,313,385 | 2/1982 | Fitzgerald | 108/48 X |
| 4,494,465 | 1/1985 | Fick . | |
| 4,501,457 | 2/1985 | Pond | 108/48 X |

*Primary Examiner*—José V. Chen

*Attorney, Agent, or Firm*—Fleit, Jacobson, Cohn, Price, Holman & Stern

[57] ABSTRACT

A foldable table structure mounted externally on a R.V. which is capable of being quickly and easily unfolded and set up in a stable condition thereby forming a table for various uses and purposes and which is also capable of being quickly and easily folded and stowed externally of the wall of a R.V. The table includes a two-part foldable tabletop having one end hinged to the R.V. and the other end supported by a pivotal, braced and adjustable leg structure. The table is mounted either by add-on bracket structures or by a recessed tray structure which securely retains the table in stowed position but yet enables the table to be quickly and easily moved between its operative position and its stowed position.

6 Claims, 2 Drawing Sheets

FIG.1
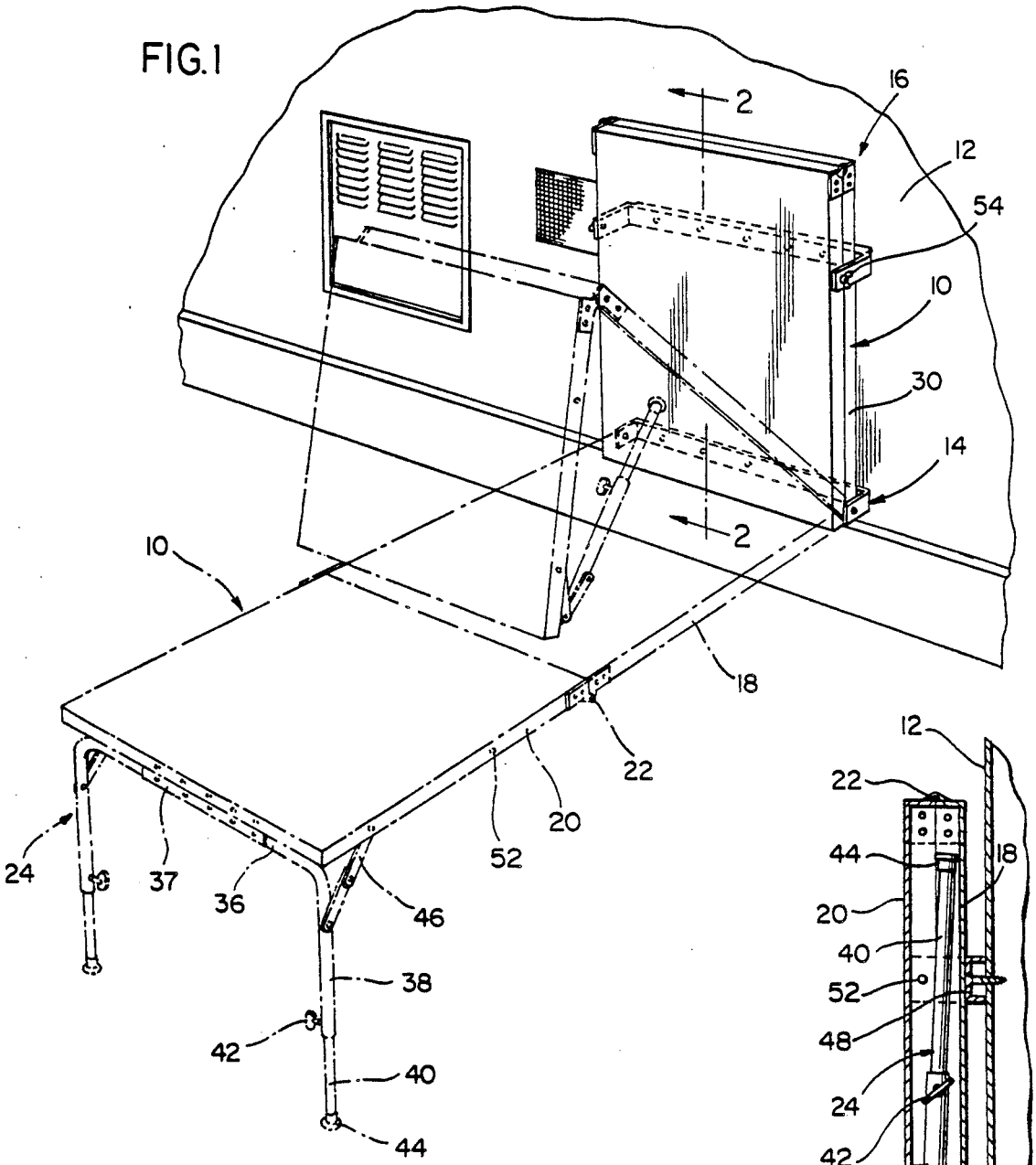
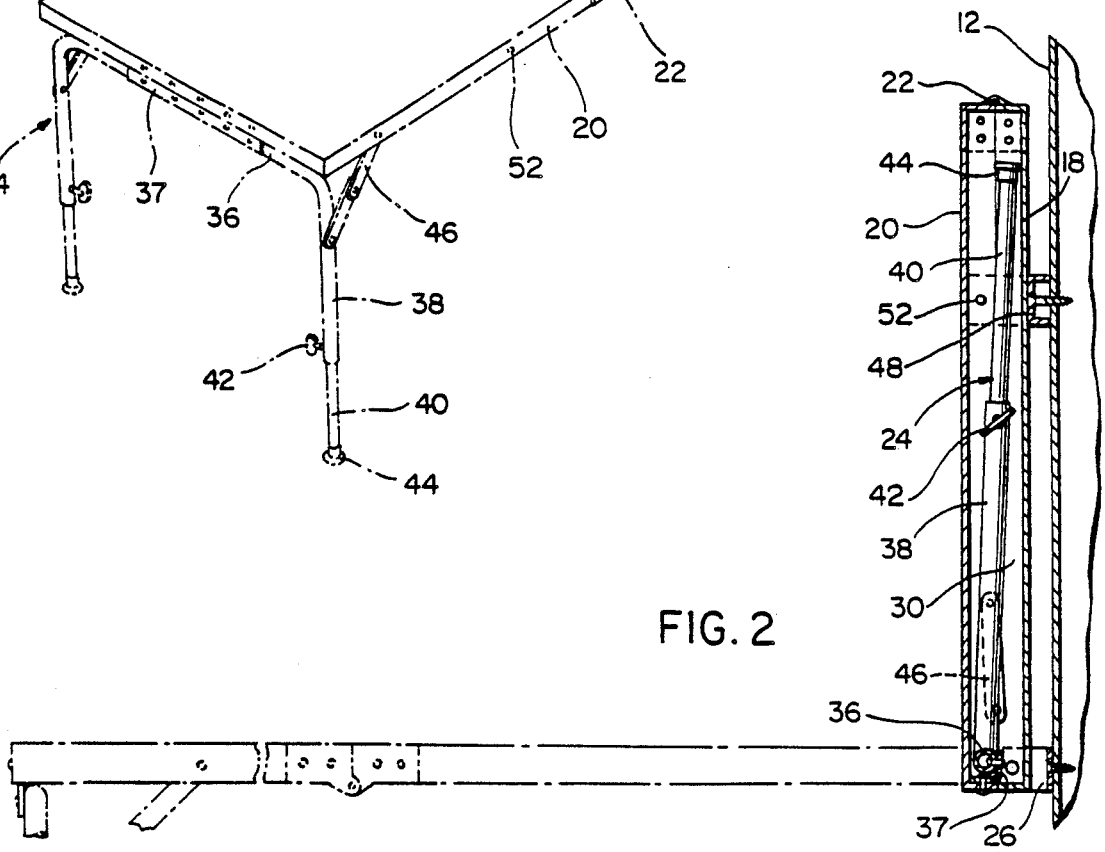
FIG. 2

EXTERNALLY MOUNTED R.V. TABLE

BACKGROUND OF THE INVENTION

1. Field of the Invention

This invention generally relates to a foldable table structure mounted externally on a R.V. which is capable of being quickly and easily unfolded and set up in a stable condition thereby forming a table for various uses and purposes and which is also capable of being quickly and easily folded and stowed externally of the wall of a R.V. The table includes a two-part foldable tabletop having one end hinged to the R.V. and the other end supported by a pivotal, braced and adjustable leg structure. The table is mounted either by add-on bracket structures or by a recessed tray structure which securely retains the table in stowed position but yet enables the table to be quickly and easily moved between its operative position and its stowed position.

2. Information Disclosure Statement

Foldable and collapsible tables are well known for many purposes and the prior art known to applicant accompanies a separate information disclosure statement. The prior art known to applicant does not include a structure equivalent to the present invention.

SUMMARY OF THE INVENTION

An object of the present invention is to provide an externally mounted foldable table for a recreational vehicle (R.V.) which can be mounted on the outside wall of an existing R.V. or built-in as a factory supplied item with the table being quickly and easily moved from a stowed, collapsed condition, on or recessed in the external wall of the R.V. to an extended, stably supported operative condition and just as quickly and easily returned to its stowed position.

Another object of the invention is to provide an externally mounted R.V. table which includes a hingedly connected two-panel tabletop having the inner edge pivotally connected to the R.V. and the outer edge supported by pivotal, braced supporting legs that are vertically adjustable to enable the table to be effectively supported even though the supporting surface underlying the outer end of the table may not be level.

A further object of the invention is to provide an externally mounted table in accordance with the preceding objects in which a supporting bracket and stowing bracket are provided on the external surface of the wall of the R.V. to securely retain the table in its stowed position so that the R.V. can be driven over the road without any danger of the table pivoting laterally outwardly of the wall of the R.V.

Still another object of the invention is to provide a table in accordance with the preceding objects in which the stowing bracket may be used as a convenient support for items such as a roll of paper towels and the like when the table is in its operative position.

Still another object of the invention is to provide a table in accordance with the preceding objects in which the table is supported in a recessed shallow tray incorporated into the external wall of the R.V. thereby reducing external projections on the wall of the R.V.

A still further object of the invention is to provide a foldable, collapsible table extending laterally from the external wall of an R.V. when in operable position and positioned alongside of or recessed into the external wall of the R.V. when in stowed position with the table being relatively inexpensive to manufacture and install and quick and easily moved between operative and stowed positions.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a view of the table in stowed position on the external wall of R.V. with the table being shown in broken lines in operative position and a partially unfolded position.

FIG. 2 is a vertical sectional view taken substantially upon a plane passing along section line 2—2 on FIG. 1 illustrating the structural details of the table and brackets.

DESCRIPTION OF THE PREFERRED EMBODIMENTS

Figure 3:
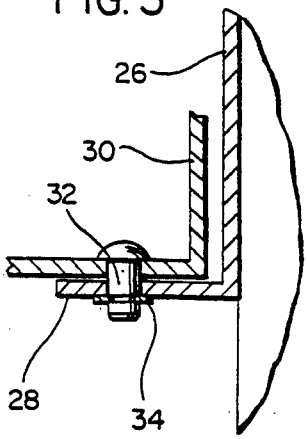
FIG. 3 is a fragmental sectional view illustrating the manner in which the inner edge of the foldable table is secured to an externally mount bracket on the R.V. wall.

Referring now specifically to FIGS. 1–4, the externally mounted table of the present invention is generally designated by numeral 10 and is mounted on the exterior of a wall 12 of a R.V. and includes a lower mounting bracket assembly 14 and an upper stowing bracket assembly 16. The table 10 includes a pair of tabletop panels 18 and 20 hingedly connected together by a hinge structure 22 with the inner edge of the inner panel 18 being pivotally connected to the mounting bracket 14 and the outer edge of the outer tabletop 20 being supported by a leg assembly 24. As illustrated in FIG. 3, the mounting bracket assembly 14 includes an elongated strap-type bracket 26 secured to the wall 12 in any suitable manner with each end of the bracket 26 including an outwardly projecting flange or lug 28 perpendicular with respect to the bracket 26. The tabletop panels 18 and 20 include depending peripheral flanges 30 with the side edge flanges telescoped in relation to the supporting flanges 28 with a fastening device 32 extending therethrough which may be any of several conventional fastening devices inCluding a pin with a head and retaining spring 34 so that the inner edge of the inner panel 18 is hingedly supported from the wall 12 of the R.V. so that it can swing upwardly to a stowed position. The hinge structure 22 interconnecting the panels 18 and 20 is oriented at the lower edge of the side flanges on the panels so that the end flanges on the adjacent ends of the panels 18 and 20 will abut and retain the panels 18 and 20 in horizontal alignment.

The leg assembly 24 includes a horizontally extending tubular member 36 terminating in a pair of laterally extending tubular legs 38 which telescopically receive lower tubular legs 40 that are secured in telescopically adjusted position by a thumbscrew 42. The lower end of each adjustable leg 40 is provided with a foot member 44 which may be resilient or pivotal to enable it to adapt to the supporting surface such as a ground surface, ,concrete or the like in order to support the table 10 when the legs 38 and 40 are in vertical, perpendicular relation to the table 20. The horizontal component is pivotally secured to the outer end of the tabletop panel 20 by a hinge structure 37 and side braces 46 interconnect the side flange of the panel 20 and the legs 38 to releasably secure the leg assembly 14 in perpendicular relation to the tabletop panel 20 with the braces 46 being conventional in and of themselves and capable of being easily folded to an inline position or an acute angular overlying position when the leg assembly is folded to a position interiorly of the flanges on the tabletop panel 20.

Figure 4:
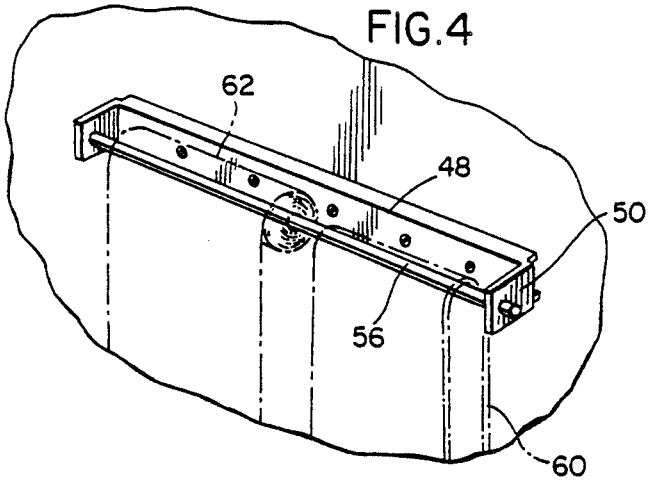
FIG. 4 a fragmental perspective view illustrating the stowing bracket used to support a roll of paper towels and a fabric towel.

To secure the table in folded and collapsed position for storage along the outer surface of the wall 12, the bracket assembly 16 includes an elongated strap 48 secured to the wall 12 in a conventional manner with end flanges 50 being provided thereon and provided with apertures which are alignable with apertures 52 in the flanges of the tabletop panel 20 for receiving thumb bolts 54 therethrough in order to securely retain the table in stowed position as illustrated in FIGS. 1 and 2. As illustrated in FIG. 4, the flanges 50 may receive a towel bar or rod 56 when the table is in operative position in order to support a roll of paper towels 62 or a fabric towel 60 in a conventional manner thereby providing a convenient supporting structure for a roll of paper towels, a fabric towel or other items desired to be supported in accessible position to the tabletop surface. When the table is to be stowed, the rod along with the paper towels, fabric towel and the like are removed and stored in a convenient location within the R.V.

With this structure, the table is securely stowed for over the road movement of the R.V. and when the R.V. is parked, the table can be easily extended by removing the thumb bolts, unfolding the table and unfolding the legs with the braces being frictionally locked in place and the length of the supporting legs may be adjusted so that the table will be securely supported and the table will provide a convenient tabletop surface at a desired height that enables conventional chairs to be used in association with the table for various purposes.

Figure 5:
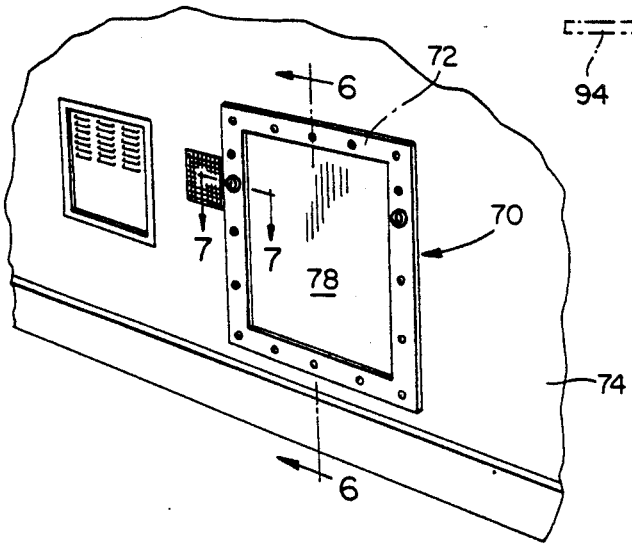
FIG. 5 is a fragmental perspective view of an embodiment of the table recessed into the R.V. wall.
Figure 7:
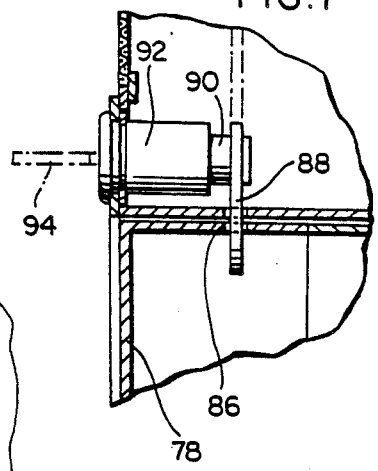
FIG. 7 a sectional view taken along section line 7—7 on FIG. 5 illustrating a securing lock to retain the table in stowed position.
Figure 7:
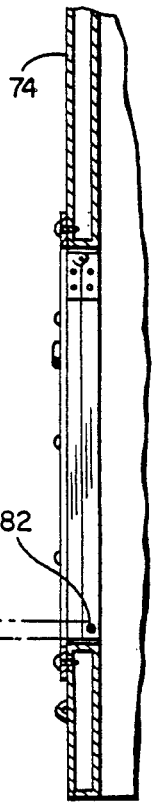
Figure 6:
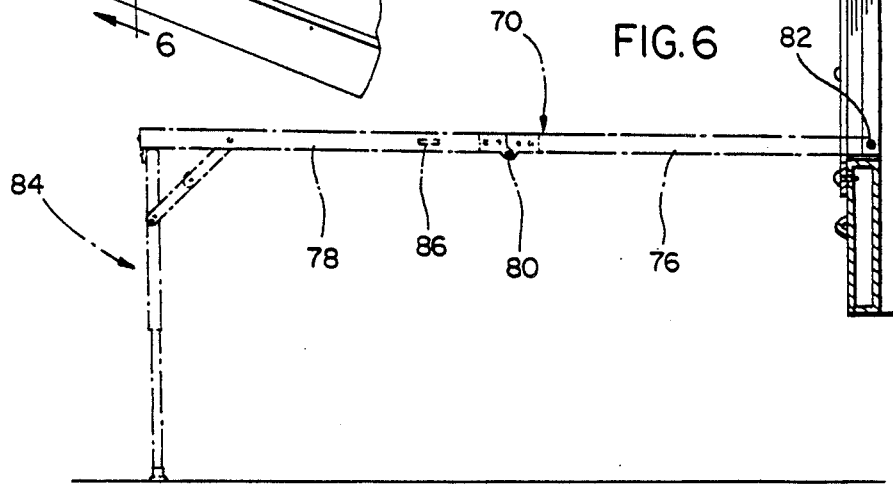
FIG. 6 a sectional view taken substantially upon a plane passing along section line 6—6 on FIG. 5.

FIGS. 5–7 illustrate a second embodiment of the table generally designated by numeral 70 which includes a flanged shallow tray 72 recessed into the wall 74 of the R.V. with the table 70 including two panels 76 and 78 hingedly connected by hinge 80 and pivoted interiorly of the tray 72 by a hinge pin 82. A leg assembly 84 similar to the leg assembly 24 is supported at the outer end of the outer tabletop panel 78. In this construction, when the table is folded to its stowed position, it will be oriented within the confines of the shallow tray 72 and the side flanges of the outer table panel 78 are each provided with slots 86 which receive a locking lug or plate 88 that swings laterally into and out of the slots 86. The lock plate 88 is eccentrically mounted on a shaft 90 supported by a lock cylinder 92 provided with a key or other operating mechanism 94 by which the lock plate 88 can be swung inwardly into engagement with the slot 86 or retracted therefrom with the key operator 94 being removable if desired.

In both embodiments of the invention, the outer end of the table is adjustably supported with unevenness of the supporting terrain being accommodated by the individually adjustable leg components at each side of the outer end of the table. The folding braces 46 and the hinged connection 37 connecting the leg assembly to the table which may conveniently be a piano hinge or the like enable the table to be lifted at the outer end, the leg assembly folded inwardly and then the table is lifted upwardly at the center so that the hinge 22 is moved upwardly to enable the table to be folded into a position either between the flanges 50 on the stowage bracket 16 or interiorly of the outer flanges on the shallow tray embodiment of the invention illustrated in FIGS. 5–7. The securing means for retaining the table in stowed position is secure and will retain the table in its stowed position during over the road movement of the vehicle. If desired, a permanent light may be mounted on the wall 12 above the table so that the table can be illuminated for use at night if desired. Also, installation of the table will not affect other components normally found on mobile homes, campers or other recreational vehicles. The addition of the table provides a conveniently used and readily accessible table which can be quickly and easily moved between stowed and operative positions thereby enhancing the enjoyment of R.V.s by their owners or users.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A table comprising a pair of elongated tabletop panels each having a planar top surface, a hinged connection between adjacent ends of said panels, an adjustable leg assembly supporting an end of one of the tabletop panels remote from the hinged connection and means pivotally connecting an end of the other tabletop panel remote from the hinged connection to a vertical exterior wall of a R.V., and means securing the table in stowed position against the wall of the R.V., said adjustable leg assembly including a generally U-shaped member having an elongated bight portion, a hinged connection between said bight portion and the edge portion of said one tabletop panel remote from the hinged connection between said panels, said U-shaped member having tubular leg portions extending laterally from the ends of the bight portion, each of the leg portions including a telescopically received leg member secured in adjusted position by a setscrew means, and a folding brace interconnecting the leg assembly and said one tabletop panel enabling the leg assembly to be pivoted to a collapsed position underlying said one tabletop panel whereby the adjustable leg members accommodate uneven terrain alongside the R.V.

2. The table as defined in claim 1 wherein the hinged connection between said panels includes hinge means having a hinge axis below the top surface of the tabletop panels whereby the tabletop panels may fold upwardly about the axis of the hinge means interconnecting the tabletop panels for movement into adjacent relation.

3. The table as defined in claim 1 wherein said means pivotally supporting the end of said other panel to said wall includes a bracket strap attached to the exterior wall of the R.V. and including outwardly extending flanges receiving the end of said other tabletop panel with pivot means interconnecting the flanges and the end of said other tabletop panel and a stowage bracket oriented above the support bracket strap and secured to the wall of the R.V. and including end flanges projecting laterally outwardly therefrom for receiving the tabletop panels when pivoted upwardly and inwardly to stowed position and fastening means extending through the flanges on the stowage bracket and engaging said one tabletop panel for securing the panels in stowed position alongside the wall of the R.V.

4. The table as defined in claim 3 together with a supporting bar removably mounted on said end flanges on the stowage bracket when the table is in operative position for supporting a roll of paper towels, a fabric towel or the like.

5. The table as defined in claim 1 wherein said means supporting the end of said other tabletop panel includes a shallow tray-like structure having the end of the said other tabletop panel pivotally secured thereto with the tray-like structure receiving the tabletop panels and including a laterally movable lock plate engaged with said one tabletop panel when in folded and collapsed position thereby retaining the tabletop panels in folded position within the tray-like structure.

6. In combination with a R.V. having a generally vertically disposed exterior wall having an outer surface, a rectangular recess formed in and opening to the outer surface of the wall, a shallow vertical tray mounted in the recess and opening outwardly thereof with the tray including a peripheral flange disposed against and secured to the exterior wall of the R.V., a table connected to said tray and extending laterally outwardly from the exterior wall in a generally horizontal position when in operative position and stored within the tray when in collapsed, inoperative position, said table comprising a first rectangular panel and a second rectangular panel, means pivotally connecting adjacent end edges of said panels together, means connecting the other end of one of said panels to said tray adjacent the lower end of said tray, a supporting leg assembly connected with and supporting the end of said other panel remote from the pivotally connected ends, said supporting leg assembly being pivotally connected to said other panel and including vertically adjustable leg members in spaced relation to each other to support the table in operative position on uneven terrain, the lateral depth of the tray being substantially equal to the thickness of said tabletop panels for receiving both of the tabletop panels within the tray when in inoperative position, and means interconnecting the tray and said other panel when in inoperative position for retaining the panels in stored inoperative position within the tray with the supporting leg assembly being disposed between the panels when in stored inoperative position with the planar surface of said other panel being disposed outwardly of the tray and generally flush with the peripheral flange on the tray so that the table does not project laterally from the exterior wall of the R.V.

* * * * *